US009604836B2

(12) United States Patent
Nini

(10) Patent No.: US 9,604,836 B2
(45) Date of Patent: Mar. 28, 2017

(54) SYSTEM FOR THE CONTROLLED TAPPING OF LIQUIDS FROM CONTAINERS

(75) Inventor: Diego Nini, Alessandria (IT)

(73) Assignee: VITOP MOULDING S.R.L., Alessandria (IT)

( * ) Notice: Subject to any disclaimer, the term of this patent is extended or adjusted under 35 U.S.C. 154(b) by 204 days.

(21) Appl. No.: 14/403,129

(22) PCT Filed: May 25, 2012

(86) PCT No.: PCT/IT2012/000153
§ 371 (c)(1),
(2), (4) Date: Nov. 21, 2014

(87) PCT Pub. No.: WO2013/175515
PCT Pub. Date: Nov. 28, 2013

(65) Prior Publication Data

US 2015/0096999 A1 Apr. 9, 2015

(51) Int. Cl.

| | |
|---|---|
| ***B67D 1/00*** | (2006.01) |
| ***B67D 3/04*** | (2006.01) |
| ***B65D 47/38*** | (2006.01) |
| *B65D 77/06* | (2006.01) |
| *B65D 47/08* | (2006.01) |

(52) U.S. Cl.
CPC ..... *B67D 3/043* (2013.01); *B65D 47/0838* (2013.01); *B65D 47/38* (2013.01); *B65D 47/0804* (2013.01); *B65D 77/067* (2013.01)

(58) Field of Classification Search
CPC ..... B67D 3/043; B67D 3/04; B65D 47/0838; B65D 47/38; B65D 47/0804; B65D 77/067; B65D 41/20; B65D 41/205; B65D 41/50; B65D 41/505; B65D 51/002; B65D 51/22
USPC ..... 222/81, 83, 89–91
See application file for complete search history.

(56) References Cited

U.S. PATENT DOCUMENTS

| | | | | |
|---|---|---|---|---|
| 3,884,387 A * | 5/1975 | Vannucci | B67B 7/26 | 222/538 |
| 4,325,496 A * | 4/1982 | Malpas | B65D 75/5877 | 222/83 |
| 4,375,864 A * | 3/1983 | Savage | B65D 77/067 | 141/349 |

(Continued)

FOREIGN PATENT DOCUMENTS

| | | |
|---|---|---|
| DE | 3306204 | 8/1984 |
| DE | 3412240 | 10/1985 |

(Continued)

*Primary Examiner* — Patrick M Buechner
(74) *Attorney, Agent, or Firm* — Pasadena Legal Group; Norman R. Van Treeck

(57) ABSTRACT

A system for the controlled tapping of liquid from a container where a main body is connected to a container using a connection flange. The mouth of the container is equipped with a first opening where at least one valve is interposed through the first opening. At least one tapping tap equipped with at least one connection is connected to the mouth. The mouth is integral with at least one closing plug of the opening. The plug has at least one opening next to the first opening when the plug is placed in a closed position. The mouth and the connection end to the tap can open the valve when the tap is connected to the mouth through the first and second openings to be able to move the contents of the inside of the container to the outside through the tap.

28 Claims, 16 Drawing Sheets

(56) References Cited

U.S. PATENT DOCUMENTS

| | | | | | |
|---|---|---|---|---|---|
| RE32,354 | E * | 2/1987 | Savage | B65D 77/067 | 141/349 |
| 4,708,260 | A * | 11/1987 | Siegal | B65D 77/067 | 141/351 |
| 5,111,970 | A * | 5/1992 | Rutter | B67D 3/047 | 222/105 |
| 5,188,628 | A * | 2/1993 | Rani | B65D 51/002 | 215/248 |
| 5,445,186 | A * | 8/1995 | Richter | B65D 47/2075 | 137/614.03 |
| 5,816,298 | A * | 10/1998 | Stricklin | F16L 41/16 | 137/614.04 |
| 7,163,127 | B2 * | 1/2007 | Seelhofer | B65D 47/0804 | 222/83 |
| 7,387,220 | B2 * | 6/2008 | Verespej | B65D 47/0814 | 220/254.1 |
| 8,413,857 | B2 * | 4/2013 | Johnson | B65D 75/5877 | 222/105 |
| 2004/0178220 | A1 * | 9/2004 | Smith | B67D 3/0019 | 222/83 |
| 2006/0249533 | A1 * | 11/2006 | Verespej | B65D 47/0814 | 222/81 |
| 2007/0205216 | A1 * | 9/2007 | Smith | B65D 77/067 | 222/81 |
| 2008/0029540 | A1 * | 2/2008 | Johnson | B65D 75/5877 | 222/83 |
| 2008/0053568 | A1 * | 3/2008 | Johnson | B67D 1/0082 | 141/383 |
| 2008/0179273 | A1 * | 7/2008 | Hidding | B67D 3/0032 | 215/216 |
| 2010/0122991 | A1 * | 5/2010 | Taguchi | B65D 47/106 | 222/83 |
| 2010/0176151 | A1 * | 7/2010 | Johnson | B65D 77/067 | 222/92 |
| 2010/0308056 | A1 * | 12/2010 | Brandenburger | A61J 1/2096 | 220/345.1 |
| 2011/0272405 | A1 | 11/2011 | Thurman | | |
| 2012/0031923 | A1 * | 2/2012 | Smith | B65D 47/2031 | 222/83 |
| 2012/0187158 | A1 * | 7/2012 | Pritchard | B65D 47/103 | 222/501 |

FOREIGN PATENT DOCUMENTS

| | | |
|---|---|---|
| DE | 19715077 | 5/1998 |
| DE | 19839841 | 3/2000 |
| EP | 0171870 | 2/1986 |
| EP | 0180137 | 5/1986 |
| EP | 0223717 | 5/1987 |
| EP | 0270302 | 6/1988 |
| EP | 0890544 | 1/1999 |
| FR | 2480731 | 10/1981 |
| FR | 2516496 | 5/1983 |
| FR | 2560161 | 8/1985 |
| GB | 462344 | 3/1937 |
| GB | 703140 | 1/1954 |
| GB | 714826 | 9/1954 |
| WO | 9401360 | 1/1994 |
| WO | 9610532 | 4/1996 |
| WO | 2006085347 | 8/2006 |
| WO | 2010047814 | 4/2010 |
| WO | 2010080897 | 7/2010 |

* cited by examiner

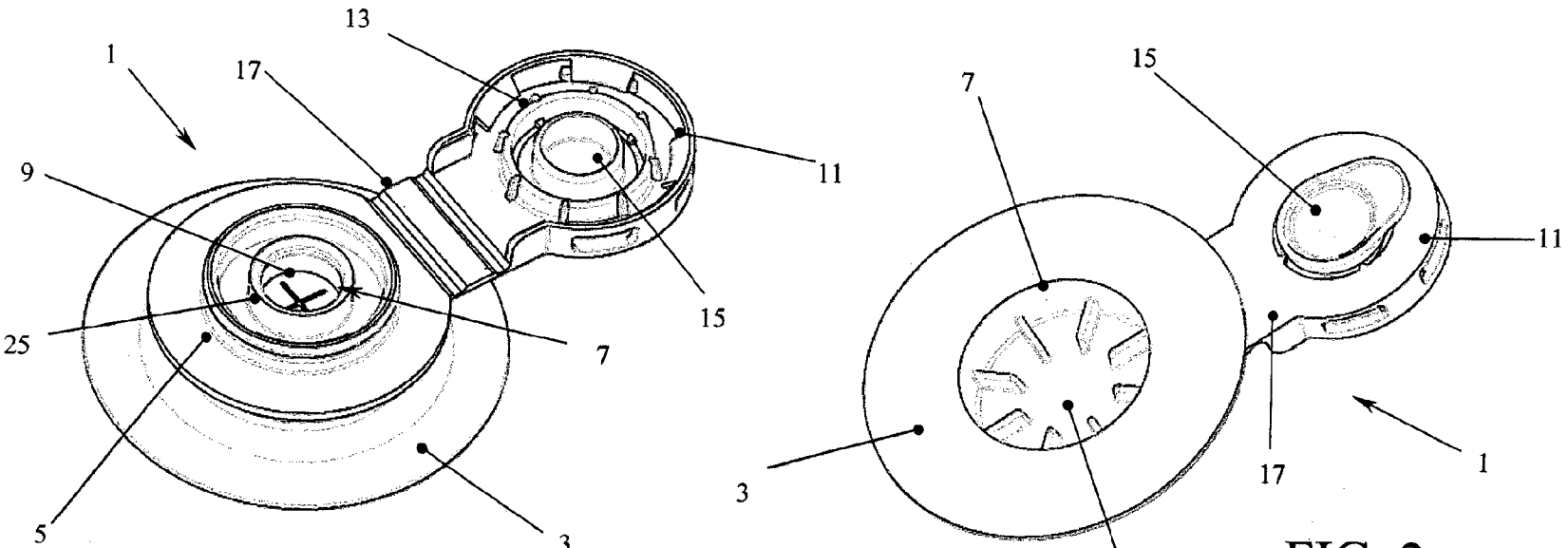
FIG. 1
FIG. 2
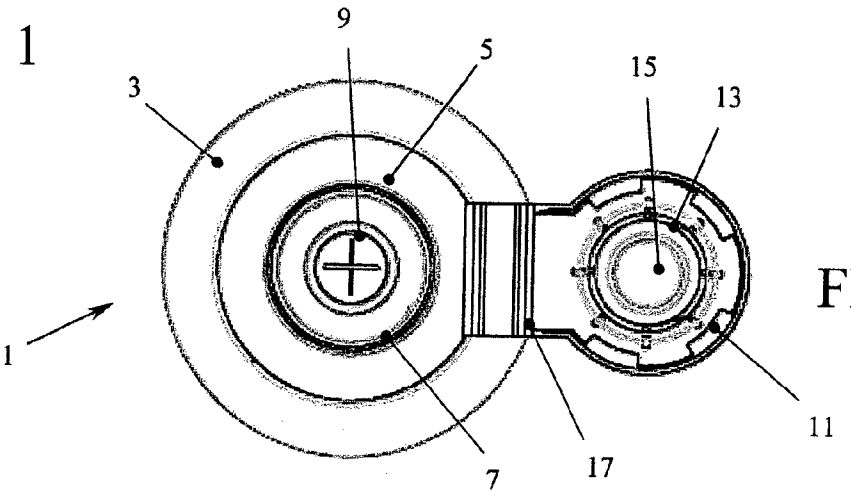
FIG. 3

SYSTEM FOR THE CONTROLLED TAPPING OF LIQUIDS FROM CONTAINERS

CROSS-REFERENCE TO RELATED APPLICATIONS

The present Application is a national stage of International Patent Application No. PCT/IT2012/000153, titled "System For The Controlled Tapping Of Liquids From Containers," filed May 25, 2012, the contents of which are incorporated in this disclosure by reference in their entirety.

BACKGROUND OF THE INVENTION

1) Field of the Invention

The present invention refers to a system for the controlled tapping of liquids from containers, in particular containers of the soft, semi-rigid or rigid type, such as those known for example as "bag-in-box", "cheerpack" or "stand up pouch", tanks, etc.

2) Background

In order to deliver liquids from containers, numerous arrangements are known in the art: some of such arrangements provide for the presence of a tapping system composed of a mouth and of a delivering valve/tap fastened thereto by means of the container mouth itself (for example of the "bag-in-box", "cheerpack" or "stand up pouch" type, tanks, etc.) and of a duct or tapping tap that can be inserted into such mouth and equipped with various means for drilling or dilatating such valve, and thereby create a flow channel for liquid to be tapped between inside of such container and outside through the duct or tap itself. Examples of sych systems are disclosed in FR2560161, EP0223717, FR2480731, EP0171870, FR2516496, DE19715077, DE3412240, WO9610532, WO9401360, GB714826, GB703140, DE19839841, EP0270302, EP0180137, EP0890544, DE3306204, WO2010047814, GB462344, WO2010080897.

In general, all known arrangements are characterised by a high number of parts, whose moulding and following assembling costs create delivering systems which are costly and scarcely eco-compatible as regards their related manufacturing processes.

Moreover, in some arrangements, the necessary mouth for the connection between tap/valve and container is equipped with at least one warranty seal (normally designated as "tamper evident") arranged on the valve, through a closing wing or "flap", that is connected to the mouth through restraining/interference; again, moulding of this high number of pieces and following assembling with welding of the flap to the valve, restraining/welding once having closed the flap so that the valve/tap has the tamper evident seal, and the necessary presence of a locking ring adapted to be inserted into the body before closing the flap to block the valve itself make the related tapping system not easy to manufacture and above all require particular production processes that rise its end price.

SUMMARY OF THE INVENTION

Therefore, object of the present invention is solving the above prior art problems by providing a system for the controlled tapping of liquids from containers comprising at least one mouth equipped with valve fastened onto the container and at least one tapping tap that can be inserted into such mouth for tapping such liquid composed of a smaller number of pieces with respect to what is proposed by the prior art, allowing lower costs and production and assembling complexity and lower environmental impacts when manufacturing.

Another object of the present invention is providing a system for the controlled tapping in which the tapping tap can be re-used many times on different containers equipped with the above mouth.

Moreover, an object of the present invention is providing a system for the controlled tapping in which the liquid container can be filled from an upper part thereof and not necessarily through its mouth only.

Another object of the present invention is providing a system for the controlled tapping in which the tamper evident seal is integrated in the mouth arranged on a closing wing or flap and does not need secondary operations, such as welding.

Moreover, an object of the present invention is providing a system for the controlled tapping in which the tapping tap, once inserted through the mouth valve, performs a seal due to its particular bit geometries and allows the controlled tapping of liquid.

Another object of the present invention is providing a system for the controlled tapping in which it is possible to adjust the sealing force of the valve inside the mouth.

The above and other objects and advantages of the invention, as will result from the following description, are obtained with a system for the controlled tapping of liquids from containers as claimed in claim 1, Preferred embodiments and non-trivial variations of the present invention are the subject matter of the dependent claims.

It is intended that all enclosed claims are an integral part of the present description.

It will be immediately obvious that numerous variations and modifications (for example related to shape, sizes, arrangements and parts with equivalent functionality) can be made to what is described, without departing from the scope of the invention as appears from the enclosed claims.

BRIEF DESCRIPTION OF THE DRAWINGS

The present invention will be better described by some preferred embodiments thereof, provided as a non-limiting example, with reference to the enclosed drawings, in which:

FIG. 1 shows a top perspective view of a preferred embodiment of a first component of the system for the controlled tapping according to the present invention;

FIG. 2 shows a bottom perspective view of the component of FIG. 1;

FIG. 3 shows a plan view of the component of FIG. 1;

DETAILED DESCRIPTION OF PREFERRED EMBODIMENTS

Figure 4:
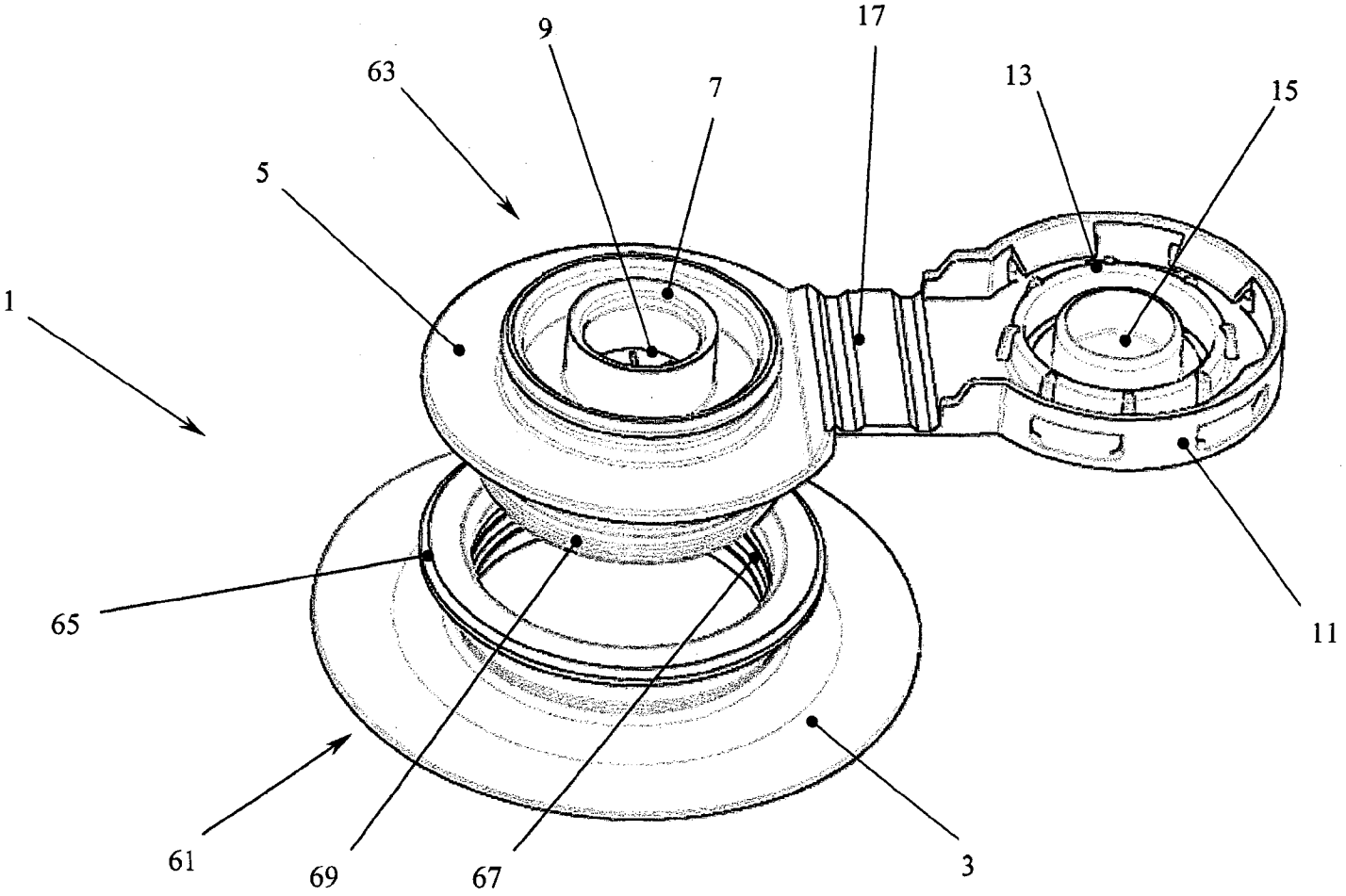
FIG. 4 shows an exploded perspective view of an alternative embodiment of the first component of the system for the controlled tapping according to the present invention.
Figure 6:
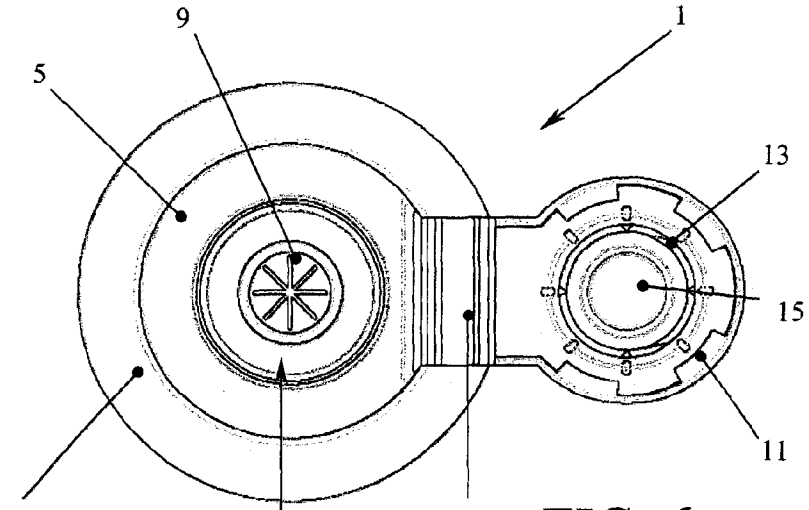
FIG. 6 shows a plan view of the component of FIG. 5.
Figure 5:
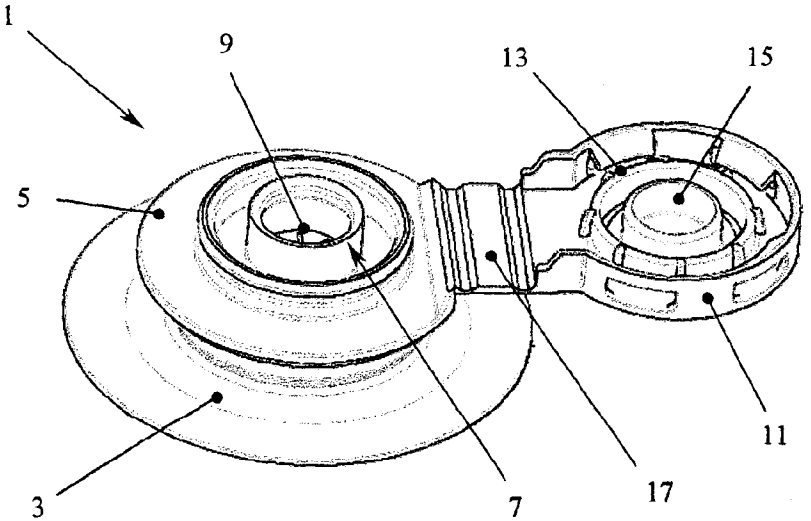
FIG. 5 shows a top perspective view of the component of FIG. 4 assembled and in an open position.
Figure 7:
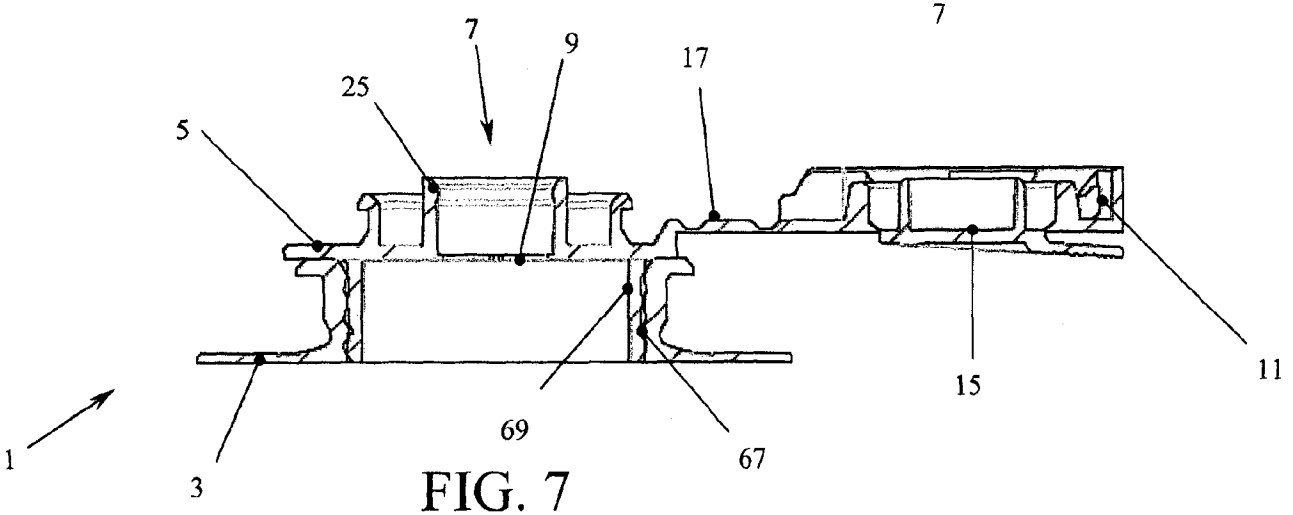
FIG. 7 shows a side sectional view of the component of FIG. 5.
Figure 9:
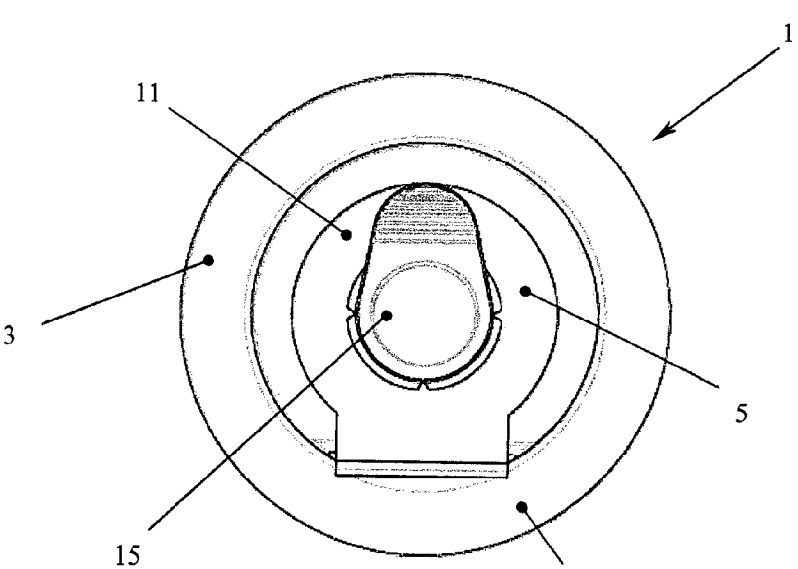
FIG. 9 shows a plan view of the component of FIG. 8.
Figure 8:
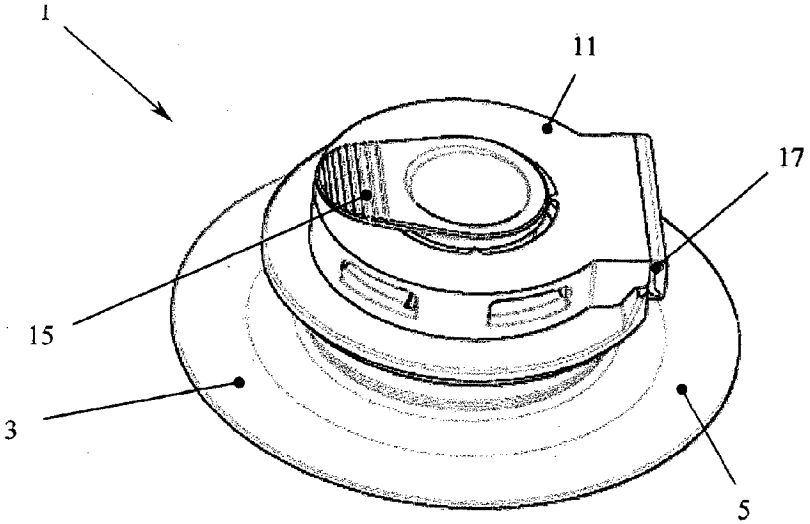
FIG. 8 shows a top perspective view of the component of FIG. 4 assembled and in a closed position.
Figure 10:
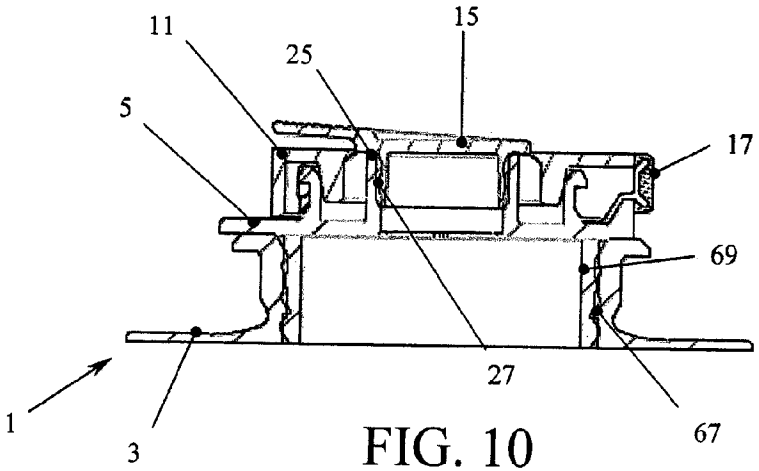
FIG. 10 shows a side sectional view of the component of FIG. 8.
Figure 11:
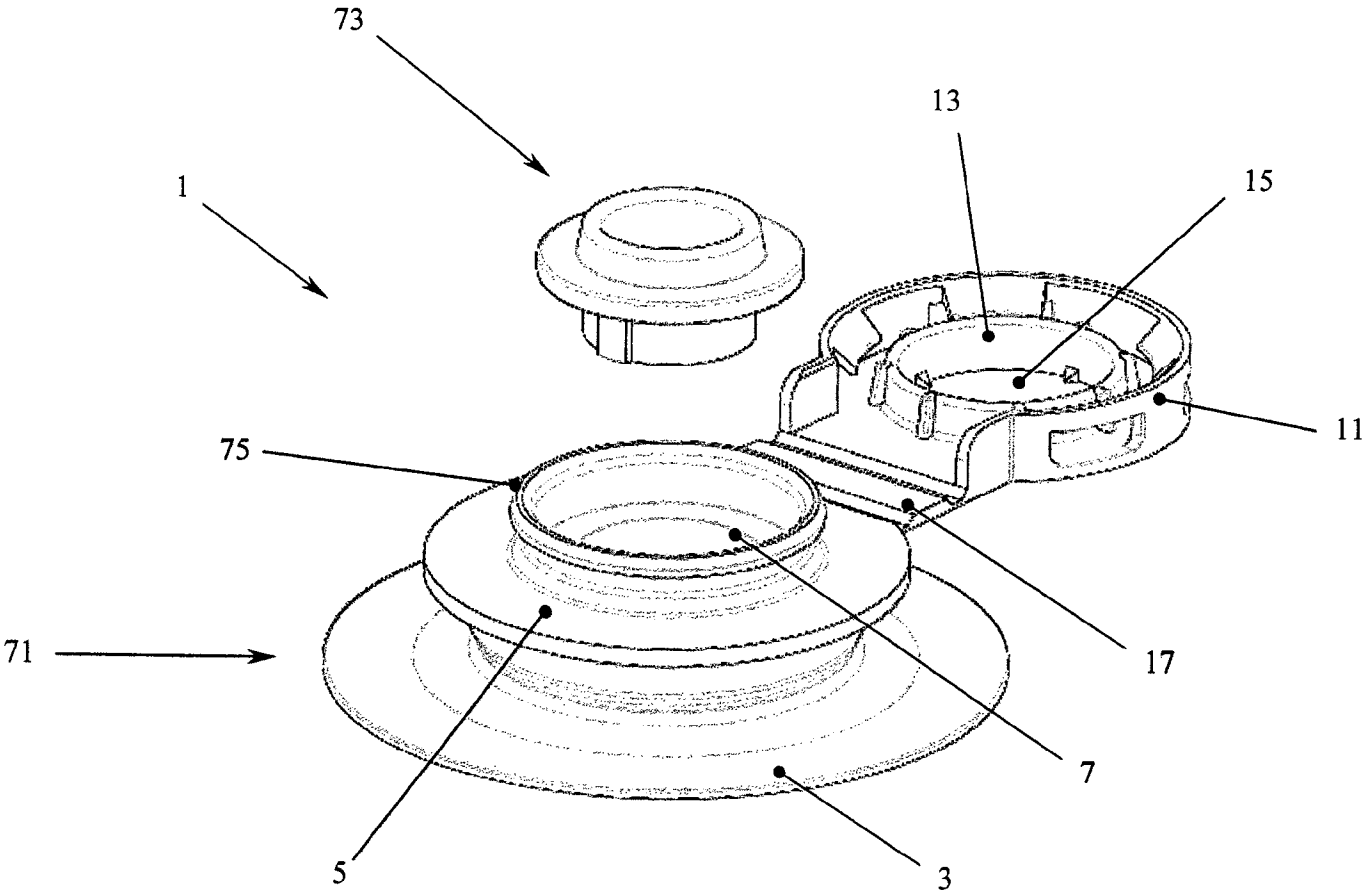
FIG. 11 shows an exploded perspective view of another alternative embodiment of the first component of the system for the controlled tapping according to the present invention.
Figure 13:
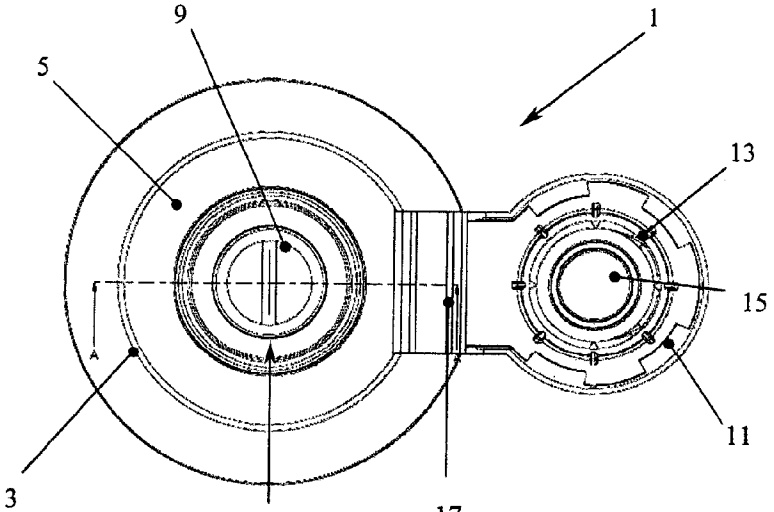
FIG. 13 shows a plan view of the component of FIG. 12.
Figure 12:
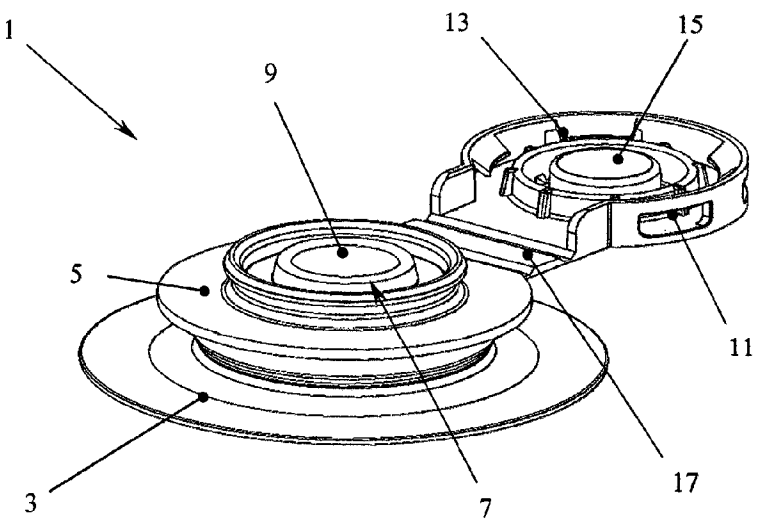
FIG. 12 shows a top perspective view of the component of FIG. 11 assembled and in an open position.
Figure 14:
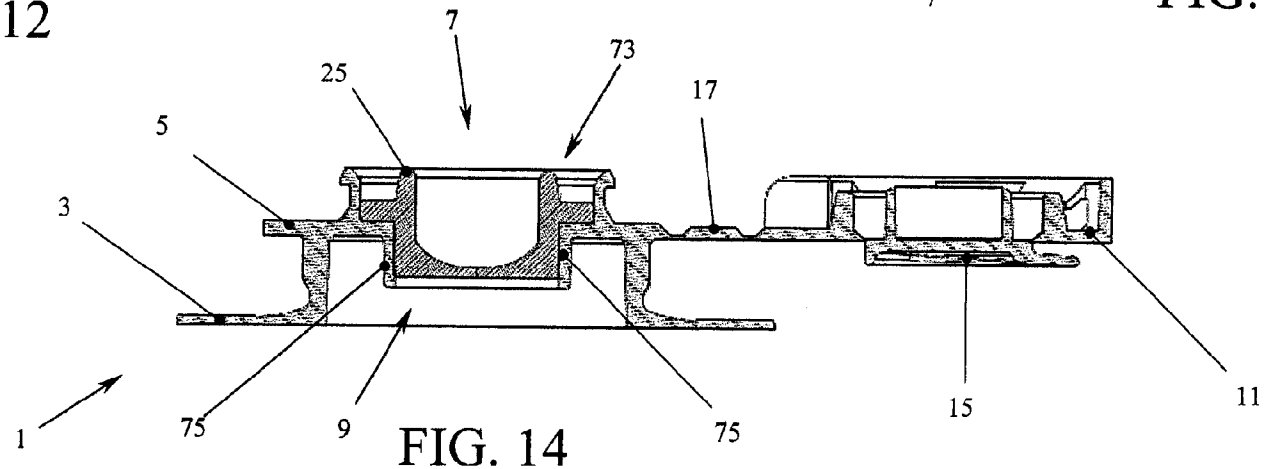
FIG. 14 shows a sectional view of the component of FIG. 5 along section line A-A in FIG. 13.
Figure 16:
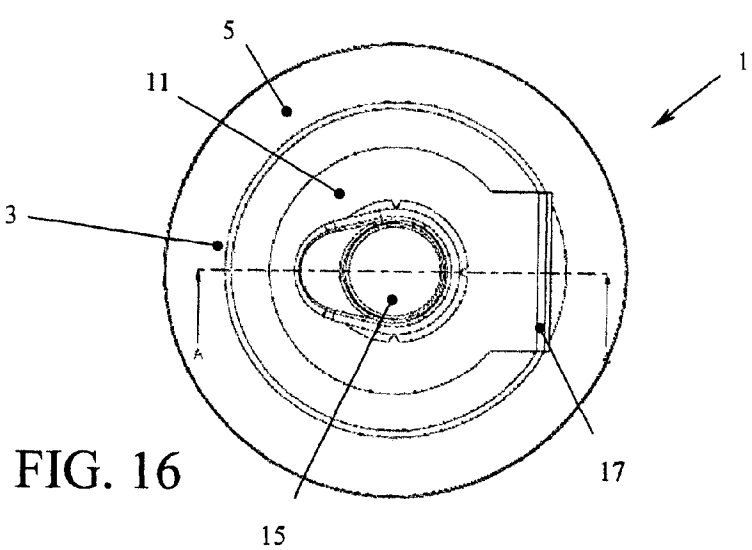
FIG. 16 shows a plan view of the component of FIG. 15.
Figure 18:
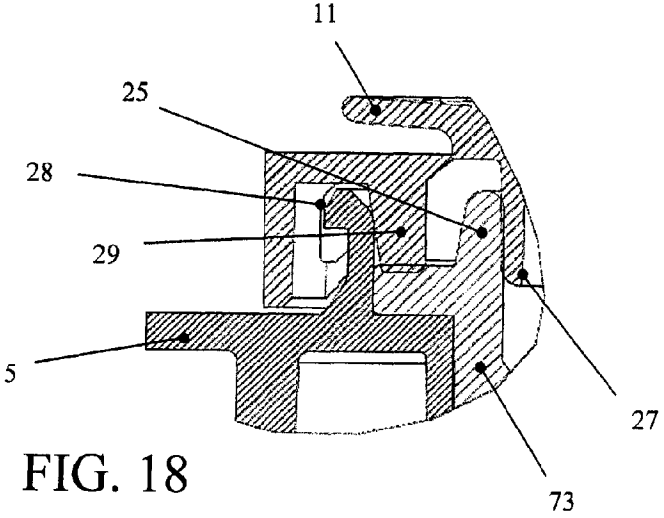
FIG. 18 shows an enlargement of the detail enclosed in circle A in FIG. 17.
Figure 15:
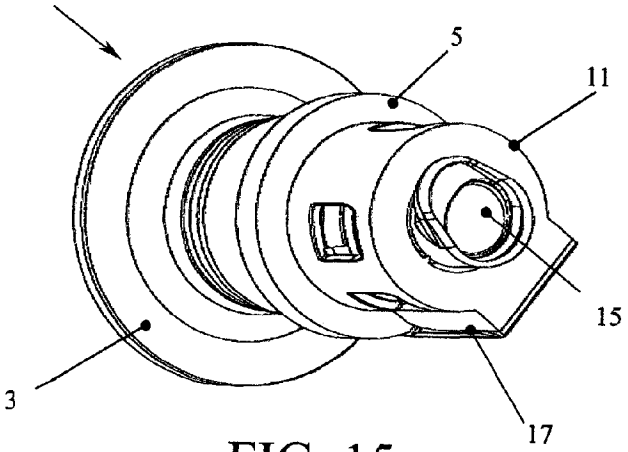
FIG. 15 shows a top perspective view of the component of FIG. 11 assembled and in a closed position.
Figure 17:
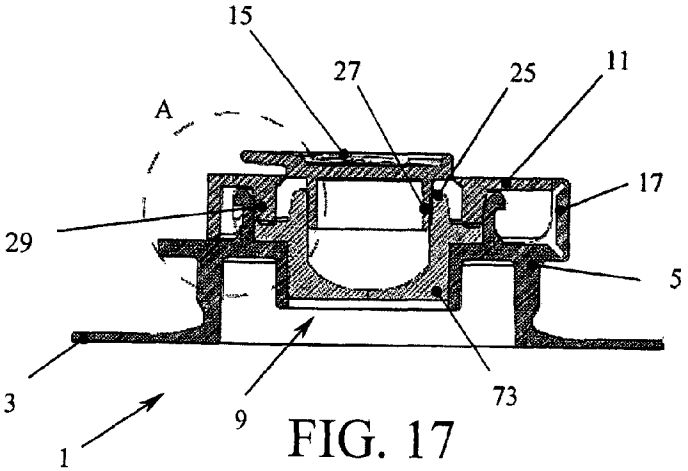
FIG. 17 shows a sectional view of the component of FIG. 15 along section line A-A of FIG. 16.
Figure 19:
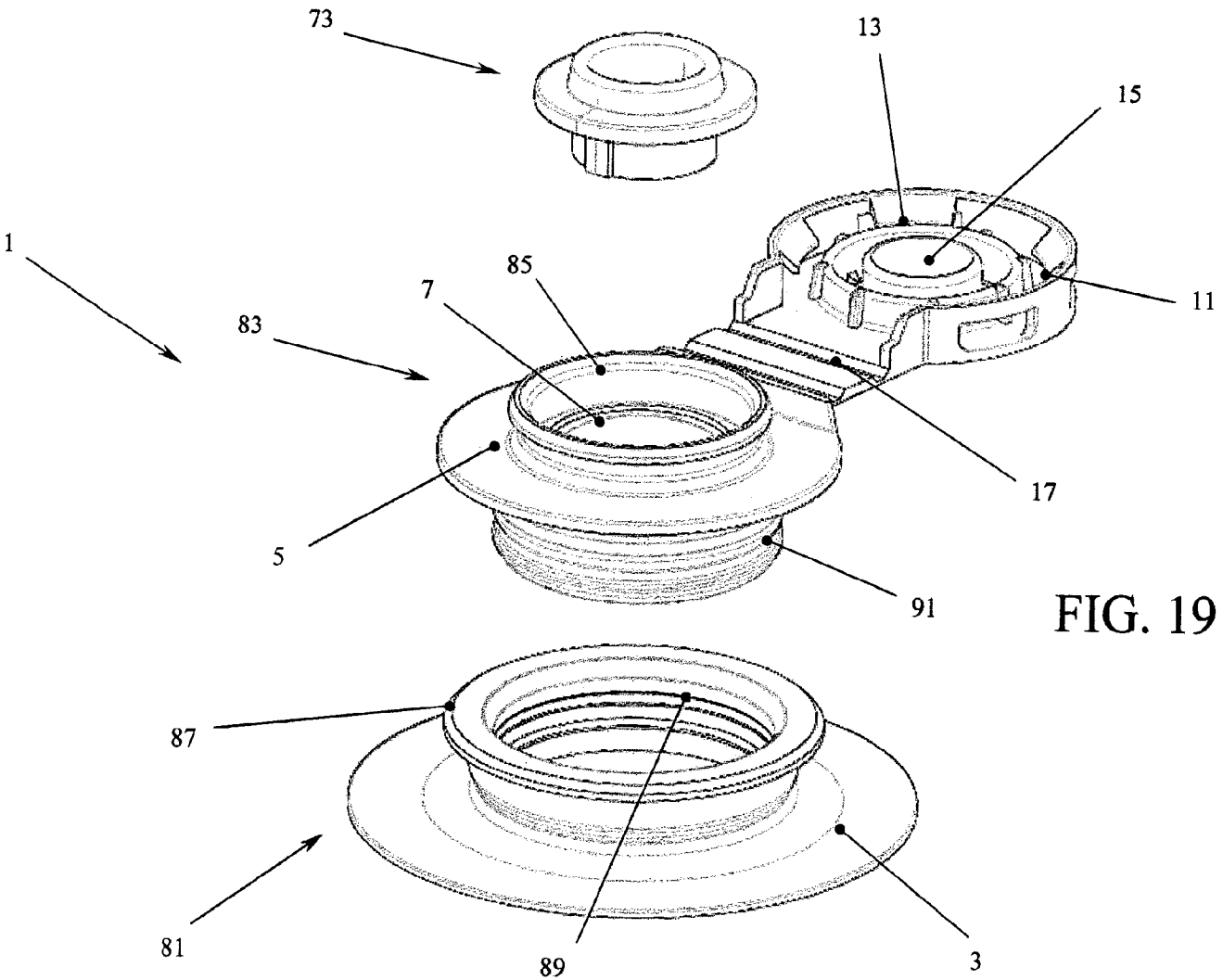
FIG. 19 shows an exploded perspective view of further alternative embodiment of the first component of the system for the controlled tapping according to the present invention.
Figure 21:
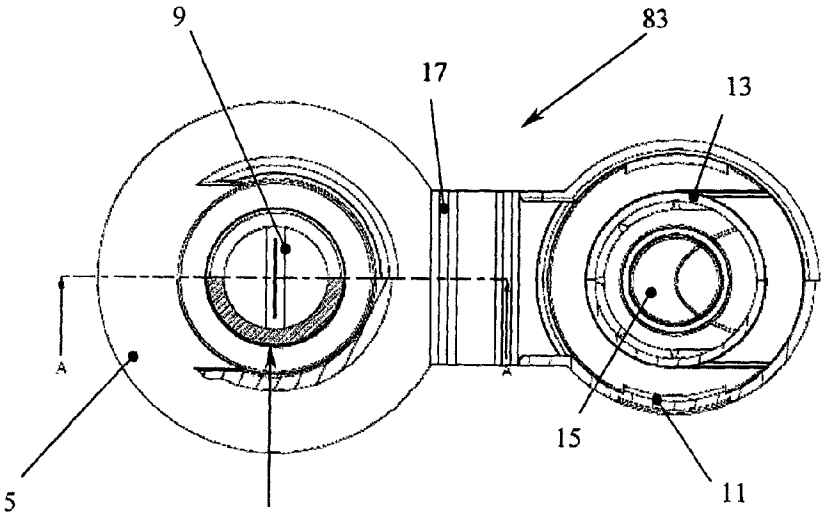
FIG. 21 shows a plan view of the element of FIG. 20.
Figure 20:
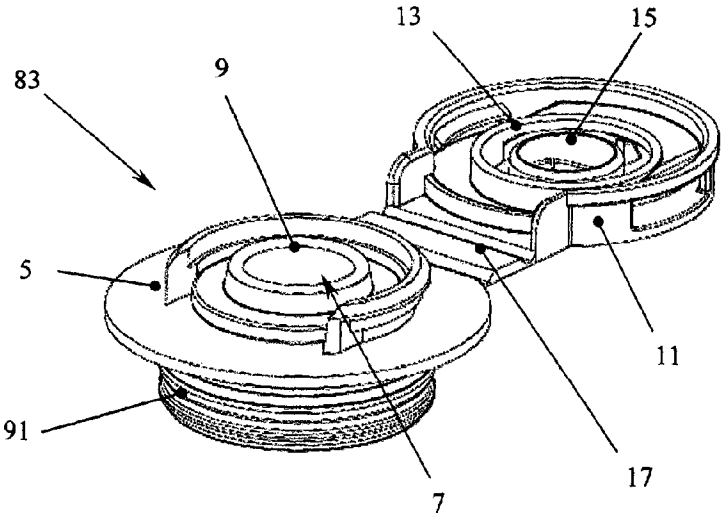
FIG. 20 shows a top perspective view of an element of the component of FIG. 19 in an open position.
Figure 22:
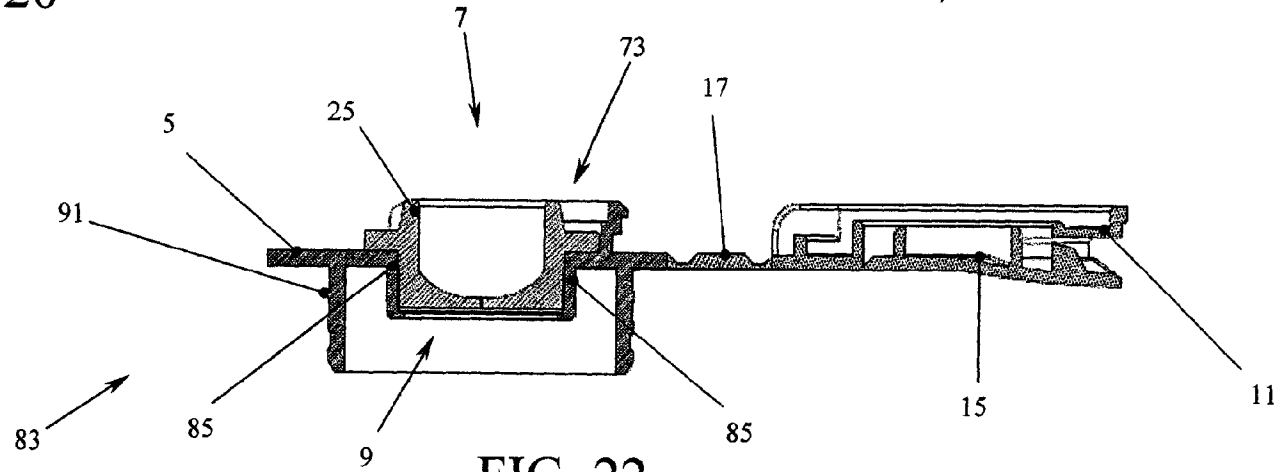
FIG. 22 shows a sectional view of the element of FIG. 20 along section line A-A of FIG. 21.
Figure 24:
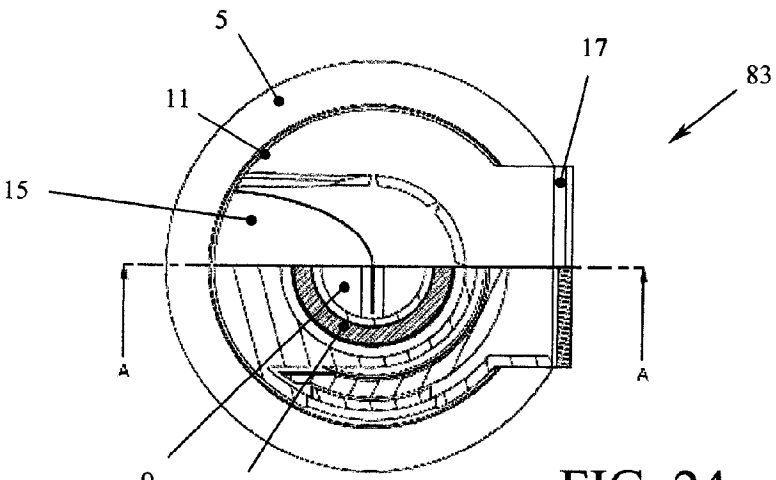
FIG. 24 shows a plan and partially sectional view of the element of FIG. 23.
Figure 26:
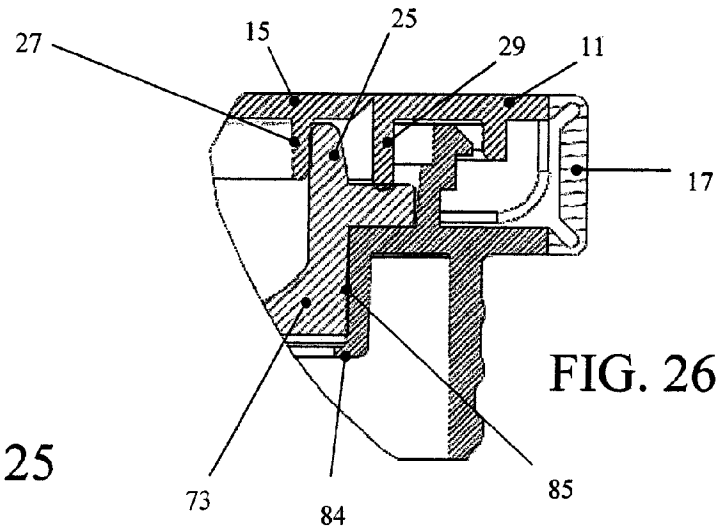
FIG. 26 shows an enlargement of the detail enclosed in circle B in FIG. 25.

With reference to the Figures, an example and non-limiting embodiment is described for the system for the controlled tapping of the invention. It will be clear for a skilled person in the art that the described system, in addition to be able to be made in equivalent shapes, sizes and parts, can be used for various types of containers, for example of the soft, semi-rigid or rigid types, such as those known for example as "bag-in-box", "cheerpack" or "stand up pouch", tanks, etc.

As shown in the Figures, the system according to the invention is used for the controlled tapping of liquids from the above container (not shown), and comprises:

at least one main body 1 adapted to be connected to such container and equipped with at least one connection flange 3 to such container, and at least one mouth 5 equipped with at least one first opening 7 communicating the inside of such container with the outside by interposing at least one valve means 9 arranged through such first opening 7;

at least one tapping tap 30 equipped with, at least one first connection end 31 to such mouth 5.

Advantageously, such mouth 5 is integral with at least one closing plug 11 of such opening 7, such plug 11 being equipped with at least one second opening 13 placed next to the first opening 7 when the plug 11 is placed in a closing position of such mouth 5 and the connection end 31 of the tap 30 is adapted to open such valve means 9 when such tap 30 is connected to such mouth 5 through such first 7 and second 13 openings to communicate the inside of such container with the outside through such tap 30.

Preferably, the plug 11 is connected to the mouth 5 by interposing at least one flexible wing ("flap") 17.

Preferably, such second opening 13 is initially closed by at least one removable cover 15 operating as warranty ("tamper evident") seal, such cover 15 being advantageously integral with such plug 11.

In particular, FIGS. 1 to 7, 11 to 14 and 19 to 22 show the mouth 5 in which the plug 11 is in an open position; FIGS. 8 to 10, 15 to 18 and 23 to 26 instead show the mouth 5 in which the plug 11 is placed in a closing position.

As it is possible to note in particular in FIGS. 30 to 33, the tapping tap 30 is further equipped with at least one internal channel 33 that communicates with such first end 31, obviously equipped with at least one opening 35 for passing liquid, with at least one delivering beak 37 for delivering the liquid tapped from the container by interposing at least one delivering system 39, substantially known in the art and actuated by a user to tap and deliver liquid from such container through such tap 30: for example, such delivering system 39 can be of a commonly known type in the art, comprising at least one valve with flexible membrane 41 adapted to open/close the communication between internal channel 33 and delivering beak 37; opening of such valve 41 is then actuated by at least one elastic thrust push-button 43 through wing-type actuating means 45. Preferably, component and liquid seal system of the tapping tap 30 are as those disclosed in WO2006085347 of the same Applicant.

As also known in the art, also the tapping tap 30 can be equipped with at least one removable warranty, tamper evident seal 47 that prevents the delivering system 39 from being actuated after having removed this seal 47.

Figure 27:
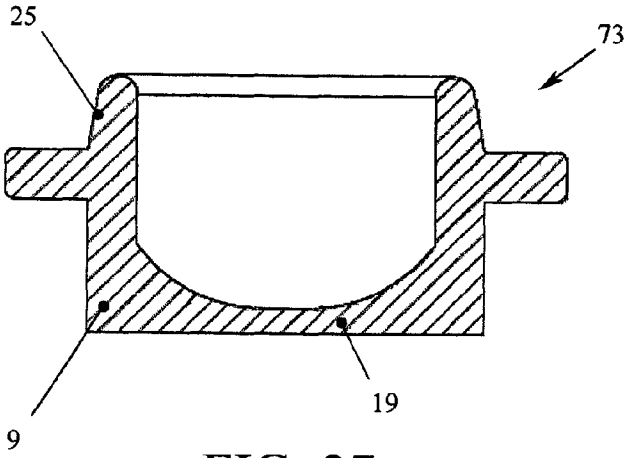
FIGS. 27, 28 and 29 show side sectional views of some preferred variations of a further element of the first component of the system for the controlled tapping according to the present invention.
Figure 28:
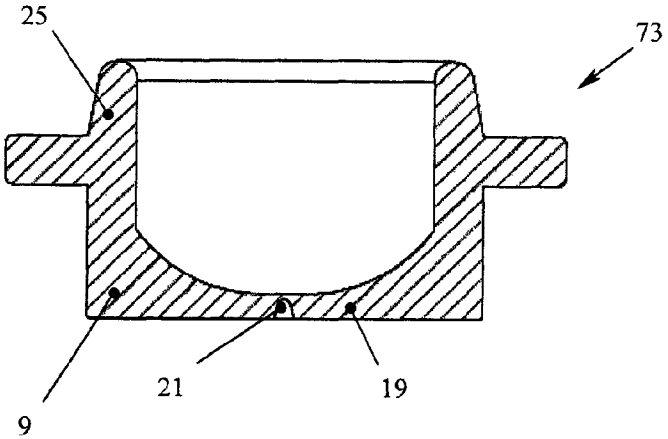
Figure 29:
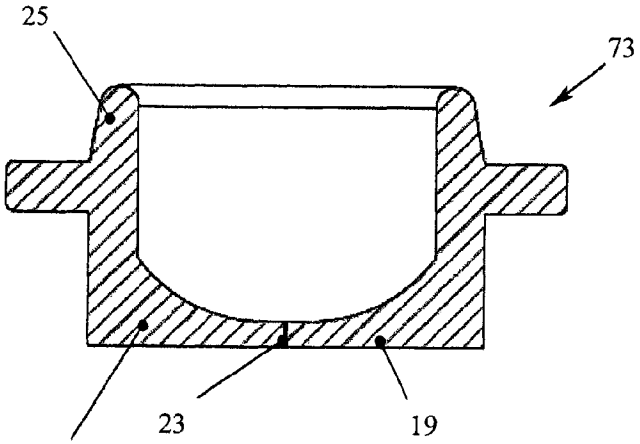
Figure 31:
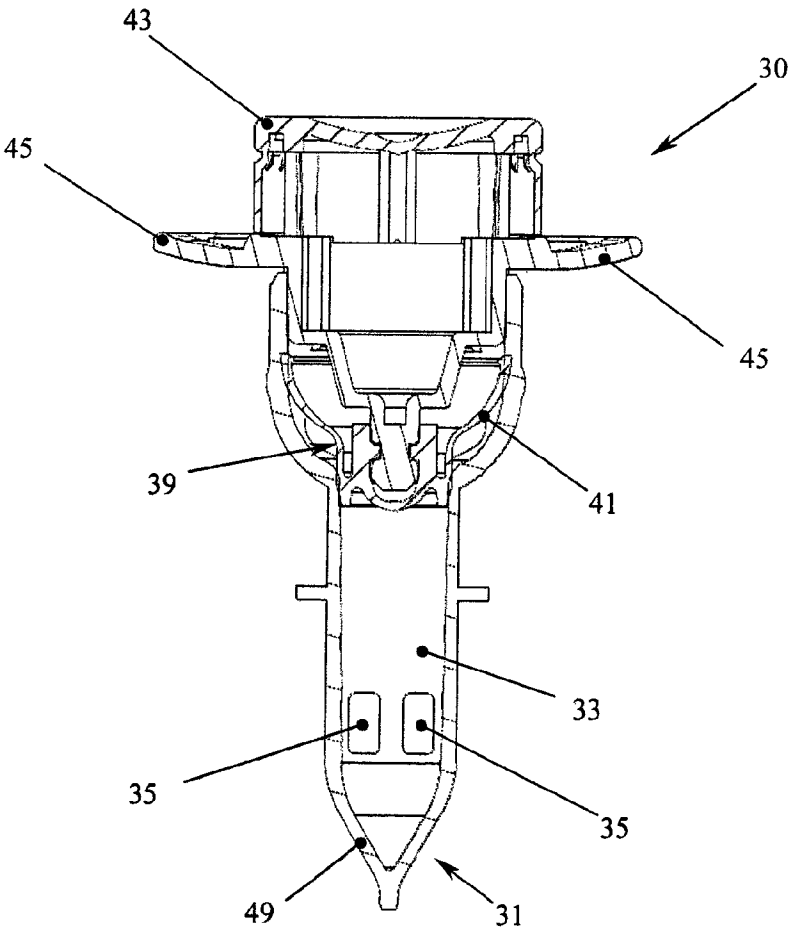
FIGS. 30 and 31 respectively show a side view and a front sectional view of a preferred embodiment of a second component of the system for the controlled tapping according to the present invention.
Figure 30:
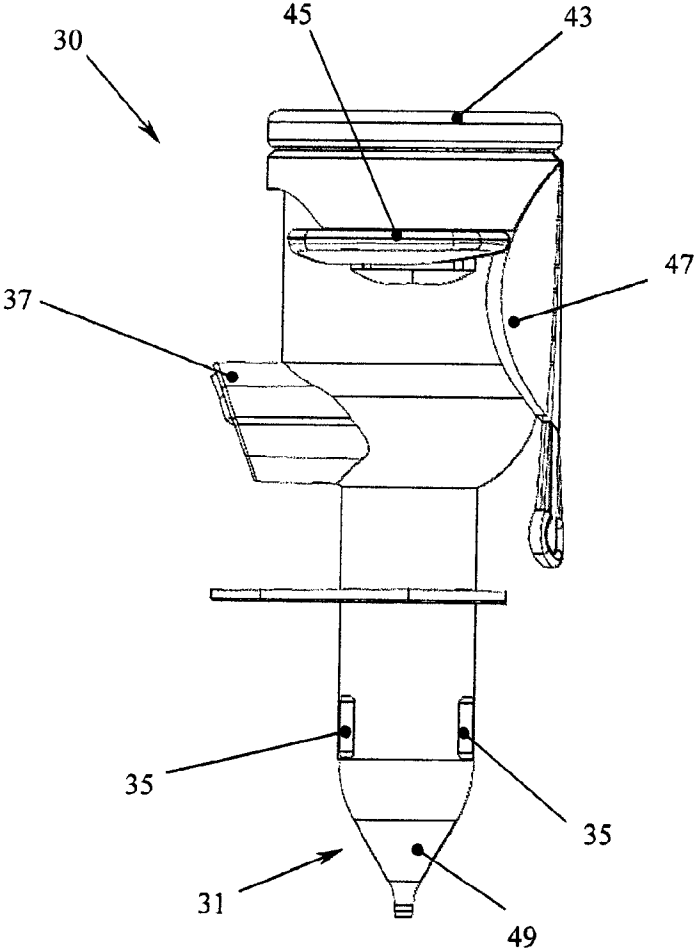
Figure 33:
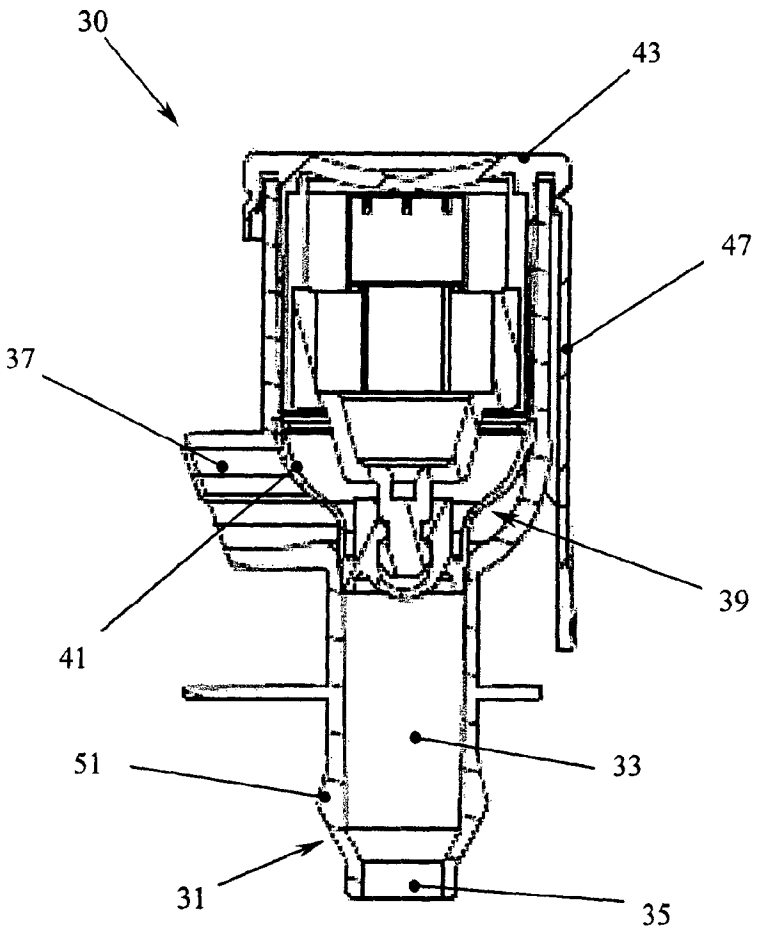
FIGS. 32 and 33 respectively show a side view and a side sectional view of an alternative embodiment of the second component of the system for the controlled tapping according to the present invention.
Figure 32:
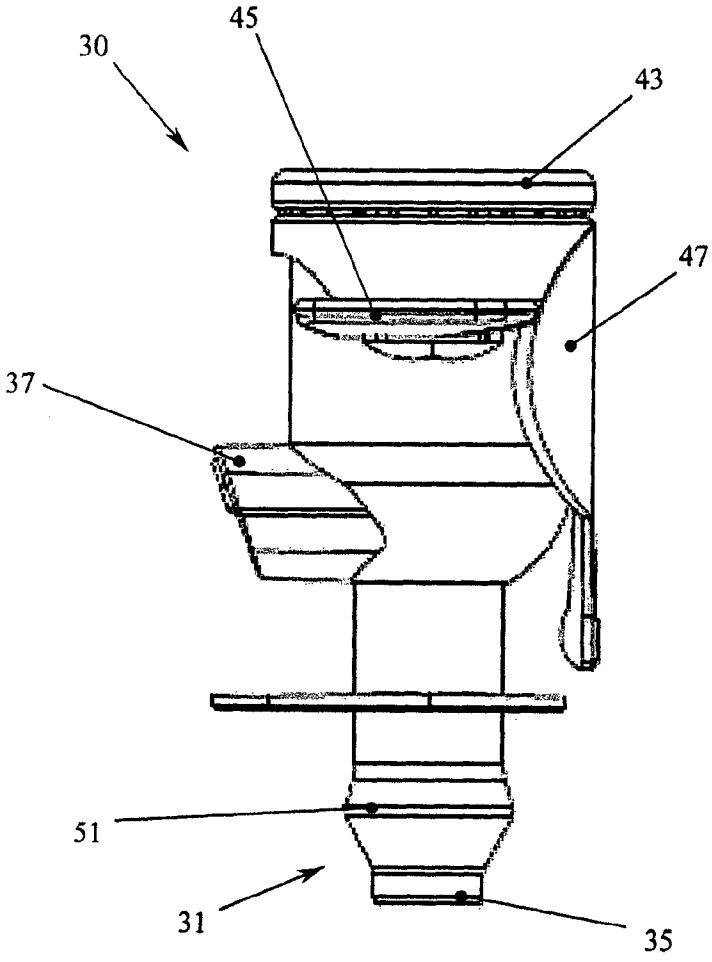
Figure 35:
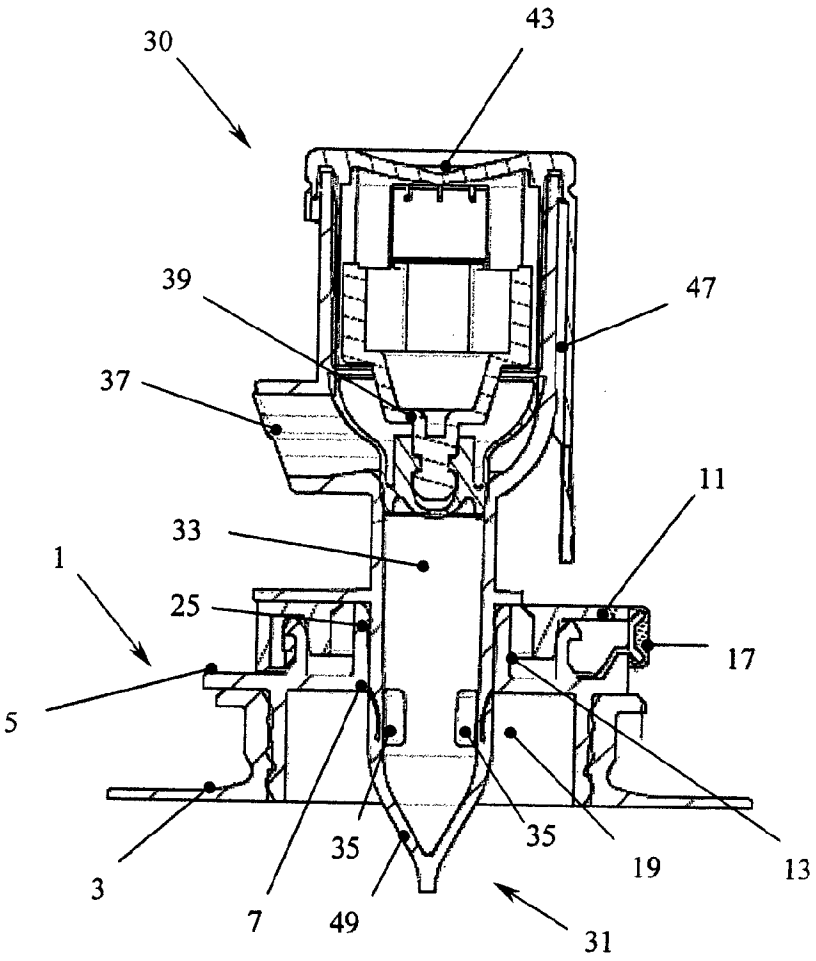
FIGS. 34, 35, 36, 37 and 38 show side sectional views of the system for the controlled tapping according to the present invention in, an operating position respectively according to its various alternative preferred embodiments.
Figure 34:
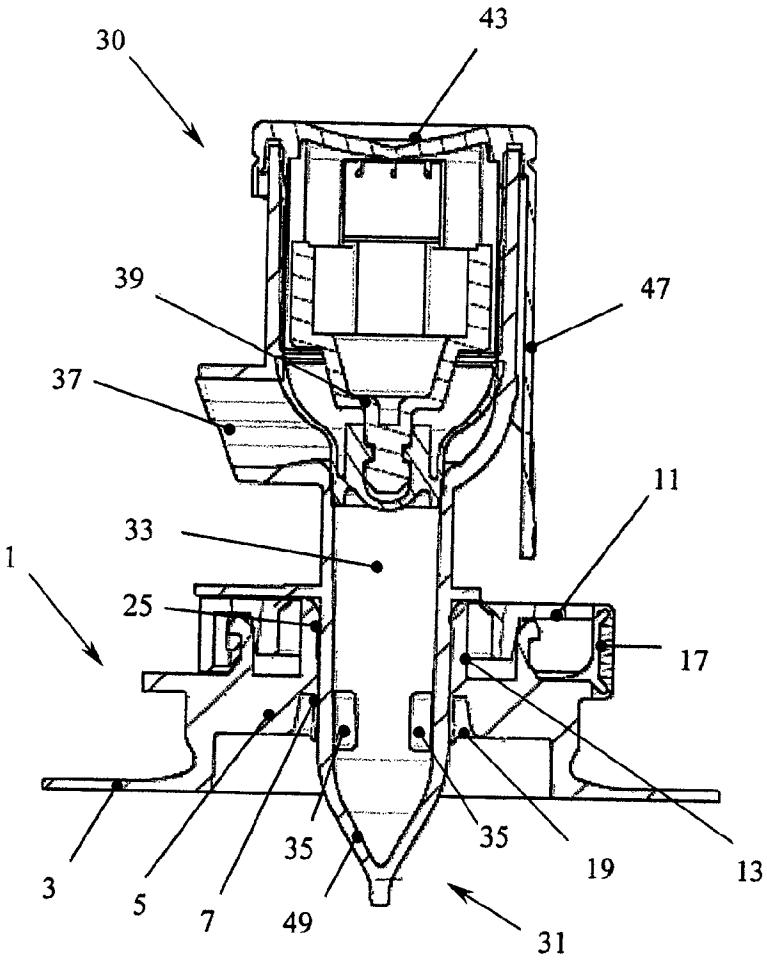
Figure 37:
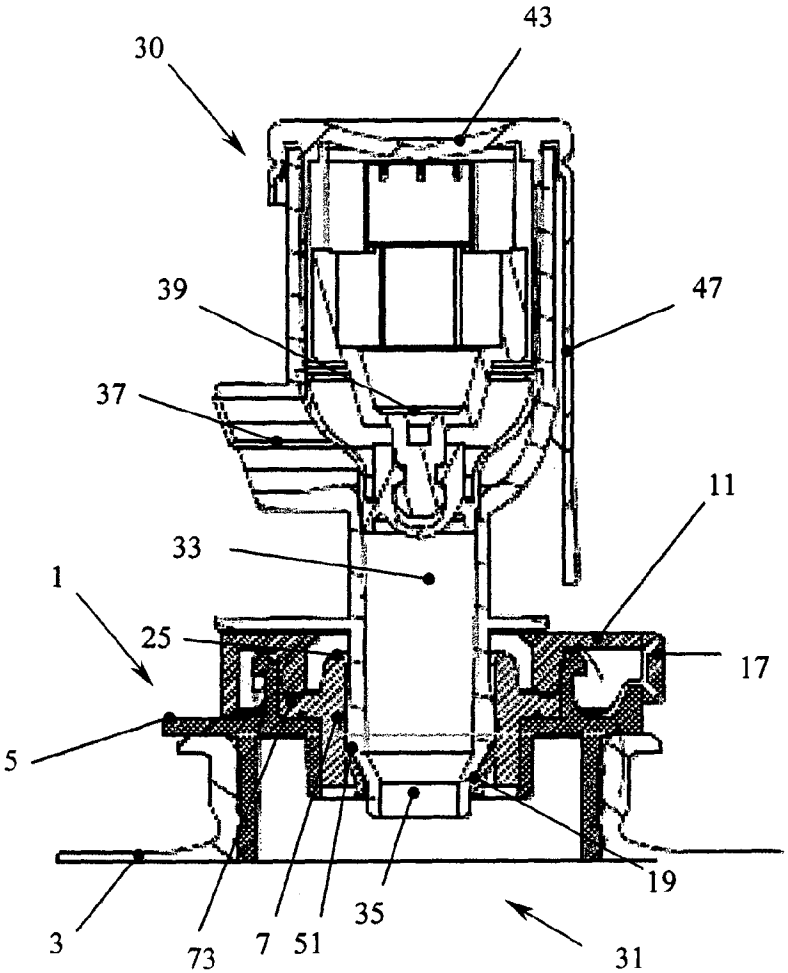
Figure 36:
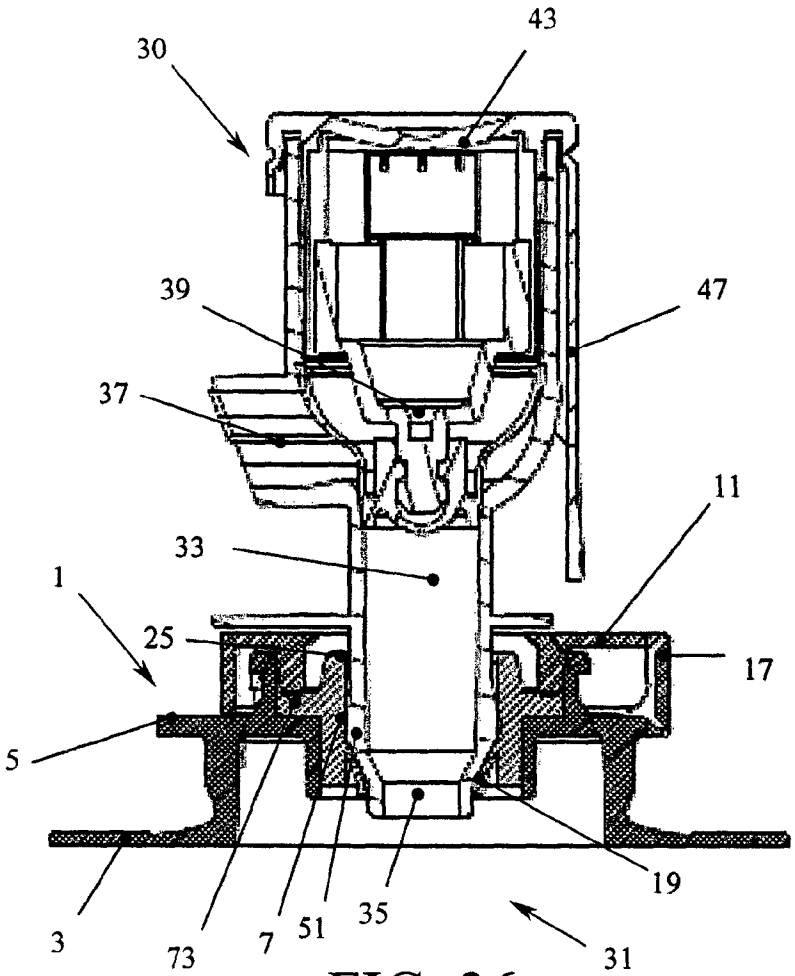
Figure 38:
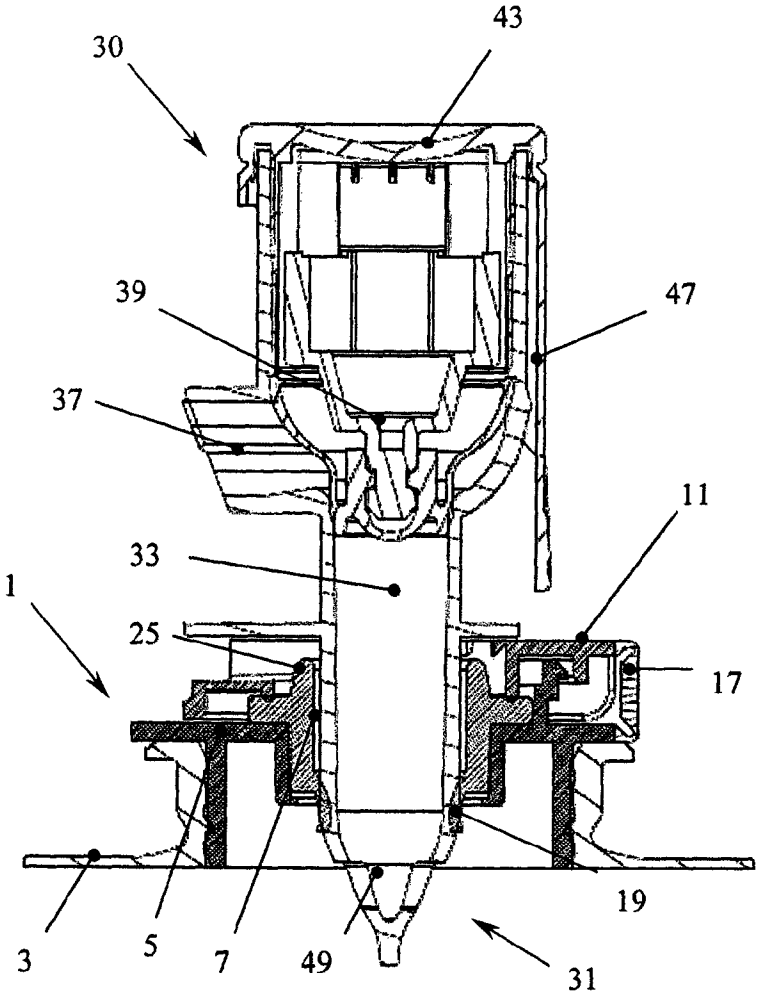

Preferably, as it is possible to note in FIGS. 27 to 29, the valve means 9 are composed of at least one flexible membrane 19 through which the first end 31 of the tapping tap 30 can pass to communicate the inside of the container with the outside through the tap 30 itself. In particular, depending on different typologies of flexible membrane 19, it is possible to provide for different arrangements of the first end 31 of the tapping tap 30; for example:

as shown for example in FIG. 27, the flexible membrane 19 can be unbroken along its surface without interruptions: in this case, it is possible to provide that the first end 31 of the tapping tap 30, in order to cross such membrane 19, is equipped at least externally with a drilling profile 49 of the membrane 19 that is substantially tapered as a bit, like the one, for example, of the tapping tap 30 of FIGS. 30 and 31;

as shown for example in FIG. 28, the flexible membrane 19 can be equipped on its surface with at least one non-through pre-cut 21: also in this case, it is possible to provide that the first end 31 of the tapping tap 30 is equipped with the drilling profile 49 of the membrane 19;

as shown for example in FIG. 29, the flexible membrane 19 can be equipped on its surface with at least one through pre-cut 23: in this case, as alternative to the typology of first end 31 with drilling profile 49, it is also possible to provide that the first end 31 of the tapping tap 30, in order to be able to cross such membrane 19, is equipped at least externally with a dilatation profile 51 of the membrane 19 through the through pre-cut 23 like the one, for example, of the tapping tap 30 of FIGS. 32 and 33.

Advantageously, as it is possible to note in particular in FIGS. 1, 7, 10, 14, 17, 22, 25, 27 to 29 and 34 to 38, the valve means 9 are equipped with at least one sealing collet 25 concentric with the first 7 and the second 13 openings, such sealing collet 25 being adapted to seal by elastic interference against the external surface of the first end 31 of the tapping tap 30 as soon as the first end 31 itself is started to be inserted inside the valve means 9, therefore even before the opening of such valve means 9 by such tap connecting end 31, consequently guaranteeing immediately the liquid seal.

In addition, the plug 11 can be equipped with a first additional sealing internal geometry 27 (as shown, for example, in FIGS. 10, 17, 18, 25 and 26) that interferes with the sealing collet 25 of the valve means 9.

Advantageously, as it is possible to note in FIGS. 1 to 3 and 34, in a first preferred embodiment thereof, the whole main body 1, namely flange 3, mouth 5, valve means 9, plug 11, flexible wing 17 and removable cover 15, has been made in a single piece, preferably through moulding in a plastic material.

Alternatively, as it is possible to note in FIGS. 4 to 10 and 35, the main body 1 is composed of at least one fastening body 61 integrating the flange 3 to be able to be fastened to the liquid container, and of at least one removable body 63 integrating mouth 5, valve means 9, plug 11, flexible wing 17 and removable cover 15 as described above. In particular, the fastening body 61 can be equipped with at least one through collet 65 adapted to house therein the removable body 63 by interposing suitable connection means: for example, such connection means can comprise a restraining-type coupling through suitable undercuts or threaded between a first threading 67 arranged inside such through collet 65 and at least one second threading 69 arranged outside such removable body 63. In this case, advantageously, the removable body 63 can be uncoupled from the fastening body 61, for example by unscrewing the threaded coupling or disengaging the restraining-type coupling between the above bodies 61, 63 to allow filling the container with liquid through the through collet 65 by means of known and widespreaded filling techniques, especially for containers of the "bag in box" or "stand up pouch" type.

In this case, preferably, the whole fastening body 61, namely the flange 3 and the through collet 65, has been made in a single piece, preferably through moulding in a plastic material; similarly, also the whole removable body 63, namely mouth 5, valve means 9, plug 11, flexible wing 17 and removable cover 15, has been made in a single piece, preferably through moulding in a plastic material.

In a further alternative, as it is possible to note in FIGS. 11 to 18 and 36, the main body 1 is composed of at least one fastening body 71 integrating flange 3, mouth 5, plug 11, flexible wing 17 and removable cover 15, and of at least one bush 73 (like the one, for example, shown in FIGS. 27 to 29) integrating the valve means 9, such bush 73 being adapted to be inserted inside at least one seat 75 of such mouth 5 comprising the first opening 7. In this case, preferably, the whole fastening body 71, namely flange 3, mouth 5, plug 11, flexible wing 17 and removable cover 15, has been made in a single piece, through moulding in a plastic material; similarly also the whole bush 73, including the valve means 9, has been made in a single piece, through moulding in a plastic material.

In another alternative embodiment, as it is possible to note in FIGS. 19 to 26, 37 and 38, the main body 1 is composed of at least one fastening body 81 integrating the flange 3 to be able to be fastened to the liquid container, of at least one removable body 83 integrating mouth 5, plug 11, flexible wing 17 and removable cover 15, and of at least one bush 73 (like the one, for example, shown in FIGS. 27 to 29) integrating the valve means 9 as described above, such bush 73 being then adapted to be inserted inside at least one seat 85 comprising the first opening 7 of such mouth 5 of such removable body 83. As already described above, also in this case the fastening body 81 can be equipped with at least one through collet 87 adapted to house therein the removable body 83 by interposing suitable connection means: for example, such connection means can comprise a restraining-type coupling between suitable undercuts or threaded between a first threading 89 arranged inside such through collet 87 and at least one second threading 91 arranged outside such removable body 83. Also in this case, advantageously, the removable body 83 can be uncoupled from the fastening body 81, for example by unscrewing the threaded coupling or disengaging the restraining-type coupling between the above bodies 81, 83 to allow filling the container with liquid through the through collet 87 by means of known and widespreaded filling techniques, especially for containers of the "bag in box" or "stand up pouch" type.

Also in this case, preferably, both the whole fastening body 81, namely flange 3 and through collet 87, and the removable body 83, namely mouth 5, plug 11, flexible wing 17 and removable cover 15, and the whole bush 73 including the valve means 9, have all respectively being made in a single piece, preferably through moulding in a plastic material.

Preferably, as it is possible to note in particular in FIGS. 14, 17 and 18, 22, 25 and 26, the bush 73 is inserted inside the respective seat 75, 85 of the mouth 5, such seat 75, 85 having preferably a cylindrical shape with such an inside diameter as to make an interference with the outside diameter of the bush 73, to apply a radial force that is discharged onto the flexible membrane 19 of the valve means 9 and, above all in case of the flexible membrane 19 equipped on its surface with at least the through pre-cut 23, generates the liquid seal, that makes the valve means 9 have a self-sealing system. Therefore, depending on the interference between inside diameter of the seat 75, 85 and outside diameter of the bush 73, the sealing force of the valve means 9 can be determined, which, in any case, will be increased when, before the first use, the removable cover 15 is still present. It must be noted as, advantageously, the inside diameter of the seat 75, 85 can be adjusted by simply changing the insert onto the die.

Moreover, the plug 11 can be equipped with further internal geometries, all preferably integrated in a single piece, comprising, in particular:

- a second internal geometry 29 (like the one, for example, shown in FIGS. 17, 18, 25 and 26) for fastening the bush 73 inside its respective seat 75, 85;
- a third fastening geometry 28 of the plug 11 to keep this latter one in its closing position.

Figure 23:
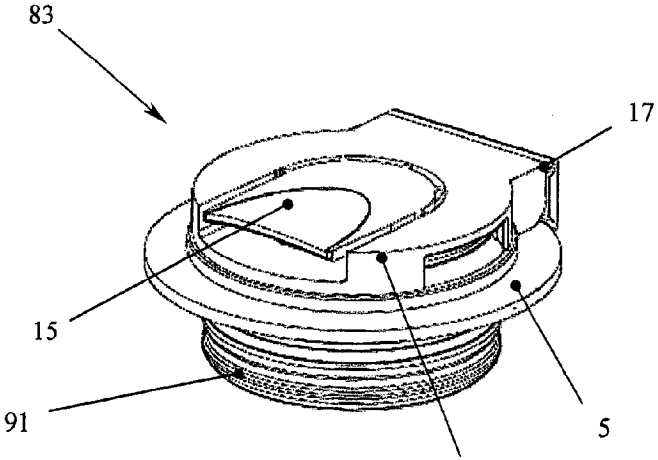
FIG. 23 shows a top perspective view of the element of FIG. 20 in a closed position.
Figure 25:
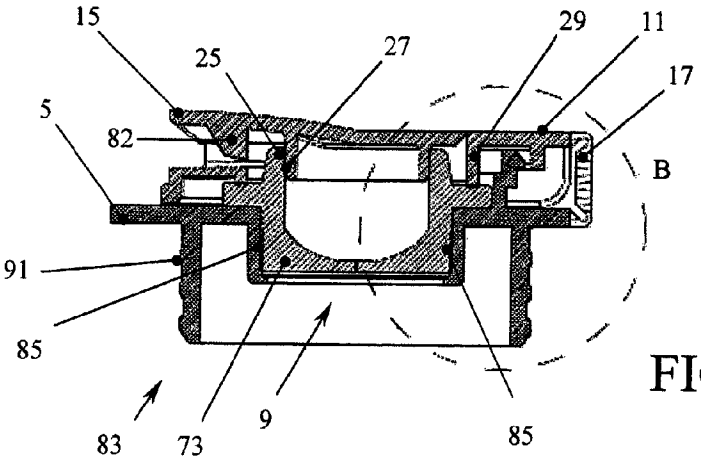
FIG. 25 shows a sectional view of the element of FIG. 23 along section line A-A of FIG. 24.

Moreover, as it is possible to note in particular in FIGS. 23 and 25:

- at least the body 83 is made in a single piece integrating the locking geometries of bush 73 and plug 11 with the removable cover 15 ("tamper evident") allowing to obtain, with respect to the above-described prior art systems, the advantages of doing without production and use of the locking ring for the valve and its related assembling and removing the "tamper evident" welding;

the plug 11 is equipped with at least one profile or tooth 82 adapted to prevent collapsing or opening of the removable cover 15 during all post-assembling steps of the body 83;

the seat 85 is equipped with at least one abutment edge 84 of the bush 73 adapted to keep in position/height the bush 73 itself when inserting the tapping tap 30.

Therefore, once having fastened, for example through gluing or welding, the main body 1 next to a suitable opening obtained on the container and having placed the plug 11 in the closing position of the mouth 5, preferably by means of restraining and undercuts, always obtained on the same piece and described below, the delivering system 1 according to the present invention allows, after having removed possible warranty seals 15, 47 and as shown for example in FIGS. 34 to 38 for the various types of couplings between the variations of main bodies 1 and tapping taps 30 as described above, inserting the first end 31 of the tapping tap 30 through the first 7 and the second 15 opening, thereby opening the valve means 9 and at the same time being able to tap the liquid, contained inside such container, for example by actuating the delivering system 39. It must be noted how it is possible, for example once having finished the liquid inside the container, to extract the tapping tap 30 from the mouth 5 and re-use such tap 30 for a certain number of times, till a user so requires, on other containers equipped with the main body 1 of the system for the controlled tapping according to the present invention, without therefore needing a further control machine, such as, for example, in some prior art tapping systems.

The invention claimed is:

1. A system for controlled tapping of liquid from a container comprising:

at least one main body adapted to be connected to the container and equipped with at least one connection flange to the container, and at least one mouth equipped with at least one first opening which communicates an inside of the container with an outside by interposing at least one valve means arranged through the first opening; and at least one tapping tap equipped with at least one first connection end to the mouth, said mouth being integral with at least one closing plug of the first opening, the closing plug being equipped with at least one second opening placed next to the first opening when the closing plug is placed in a closed position of the mouth and the connection end of the tap being adapted to open the valve means when the tap is connected to the mouth through the first and second openings to communicate the inside of the container with the outside through the tap.

2. The system according to claim 1, where the plug is connected to the mouth by interposing at least one flexible wing.

3. The system according to claim 1, where the second opening is initially closed by at least one removable cover operating as warranty seal, the cover being integral with the plug.

4. The system according to claim 1, where the tapping tap is equipped with at least one internal channel that communicates the first end equipped with at least one opening for passing the liquid with at least one delivering beak for delivering the liquid tapped from the container by interposing at least one delivering system.

5. The system according to claim 1, where the main body comprising the flange, the mouth, the valve means, the plug, the flexible wing and the removable cover, is made in a single piece.

6. The system according to claim 1, where the valve means are equipped with at least one sealing collet concentric with the first and second openings, the sealing collet being adapted to seal by elastic interference against an external surface of the first end of the tapping tap.

7. The system according to claim 6, where the plug is equipped with a first additional sealing internal geometry that interferes with the sealing collet of the valve means.

8. The system according to claim 1, where the main body comprises at least one fastening body integrating the flange, the mouth, the plug, a flexible wing and a removable cover, and of at least one bush integrating the valve means, where the at least one bush is adapted to be inserted inside at least one seat of the mouth comprising the first opening.

9. The system according to claim 8, where the fastening body comprising the flange, the mouth, the plug, the flexible wing and the removable cover, is made in a single piece, and the at least one bush comprising the valve means is made in a single piece.

10. The system according to claim 1, where the main body comprises at least one fastening body integrating the at least one connection flange and further comprising at least one removable body integrating the mouth, a valve means, the plug, at least one flexible wing and a removable cover.

11. The system according to claim 10, where the at least one fastening body is equipped with at least one through collet adapted to house therein the removable body by interposing connection means.

12. The system according to claim 10, where the at least one fastening body comprising the flange and the through collet is made in a single piece and the removable body comprising the mouth, the valve means, the plug, the at least one flexible wing and the removable cover, is made in a single piece.

13. The system according to claim 1, where the valve means are composed of at least one flexible membrane through which the first end of the tapping tap can pass to communicate the inside of the container with the outside through the tap.

14. The system according to claim 13, where the flexible membrane is unbroken on its surface without interruptions.

15. The system according to claim 14, where the first end of the tapping tap is equipped at least externally with a drilling profile.

16. The system according to claim 13, where the flexible membrane is equipped on its surface with at least one through pre-cut.

17. The system according to claim 16, where the first end of the tapping tap is equipped at least externally with a dilatation profile of the flexible membrane through the through pre-cut.

18. The system according to claim 13, where the flexible membrane is equipped on its surface with at least one non-through pre-cut.

19. The system according to claim 18, where the first end of the tapping tap is equipped at least externally with a dilatation profile of the flexible membrane through the through pre-cut.

20. The system according to claim 18, where the first end of the tapping tap is equipped at least externally with a drilling profile.

21. The system according to claim 1, where the main body comprises at least one fastening body integrating the flange, at least one removable body integrating the mouth, the plug, a flexible wing and a removable cover, and at least one bush integrating the valve means, where the bush is adapted to be inserted inside at least one seat comprising the first opening.

22. The system according to claim 21, where the bush is inserted inside the respective seat of the mouth, the seat having a cylindrical shape with an inside diameter to make an interference with an outside diameter of the bush to apply a radial force onto a flexible membrane of the valve means.

23. The system according to claim 21, where the plug is equipped with at least one second internal geometry for fastening the bush inside the seat and/or at least one third geometry for fastening the plug in its closing position.

24. The system according to claim 21, where the plug is equipped with at least one profile or tooth adapted to prevent a collapsing or an opening of the removable cover during post-assembling steps of the body.

25. The system according to claim 21, where the at least one seat is equipped with at least one abutment edge of the bush adapted to keep in position, height or both position and height, the at least one bush when inserting the tapping tap.

26. The system according to claim 21, where the fastening body is made in a single piece, and the bush comprising the valve means is made in a single piece.

27. The system according to claim 26, where the fastening body is equipped with at least one through collet adapted to house therein the removable body by interposing connection means.

28. The system according to claim 27, where the connection means comprises a restraining-type coupling through undercuts or threaded between a first threading arranged inside the through collet and at least one second threading arranged outside the removable body.

* * * * *